United States Patent [19]

Yamazaki et al.

[11] 4,253,099

[45] Feb. 24, 1981

[54] AUTOMOBILE ANTENNA

[75] Inventors: Shigeru Yamazaki, Yokohama; Akinari Mouri, Tokyo; Toshiyuki Matsuo, Kawasaki, all of Japan

[73] Assignee: Sony Corporation, Tokyo, Japan

[21] Appl. No.: 66,310

[22] Filed: Aug. 13, 1979

[30] Foreign Application Priority Data

Aug. 19, 1978 [JP] Japan ..... 53-101203

[51] Int. Cl.[3] ..... H01Q 1/32; H01Q 9/44

[52] U.S. Cl. ..... 343/713; 343/805

[58] Field of Search ..... 343/702, 711, 713, 715, 343/805, 881, 882, 908

[56] References Cited

U.S. PATENT DOCUMENTS

| | | | |
|---|---|---|---|
| 2,334,503 | 11/1943 | Paton | 343/882 |
| 2,388,567 | 11/1945 | Patterson | 343/702 |
| 2,396,121 | 3/1946 | Patino | 343/702 |
| 2,673,295 | 3/1954 | Wentworth | 343/823 |
| 2,872,677 | 2/1959 | Whipple et al. | 343/805 |
| 3,268,897 | 8/1966 | Link | 343/713 |
| 3,587,104 | 6/1971 | Budrow et al. | 343/805 |
| 3,739,387 | 6/1973 | Budrow et al. | 343/881 |

*Primary Examiner*—Eli Lieberman

*Attorney, Agent, or Firm*—Hill, Van Santen, Steadman, Chiara & Simpson

[57] ABSTRACT

An automobile antenna adapted to be mounted onto the roof of an automobile and which includes an antenna body portion formed with antenna receiving grooves which is adapted to be mounted onto the roof of the automobile with suitable suction cups or magnets mounted on the bottom of the antenna body and including a pair of rod shaped telescoping antennas which in a stored position are received in the antenna receiving grooves and which are movable to a second position to form a predetermined V-shape. Locking mechanisms lock the rod antennas in the antenna receiving grooves when in the stored position and means are provided for holding the rod antennas in the extended position when in use.

10 Claims, 14 Drawing Figures

AUTOMOBILE ANTENNA

BACKGROUND OF THE INVENTION

1. Field of the Invention

This invention relates in general to automobile antennas adapted to be mounted on the roof of an automobile and used, for example, for receiving television signals.

2. Description of the Prior Art

Different types of automobile antennas are known and generally they have the basic construction which includes an antenna body to which the antenna elements are attached and an antenna base which supports the antenna body. The antenna body is mounted with suction cups or magnets to the roof of the vehicle and the antenna body is detachably connected to the antenna base.

Under certain conditions, the projection of an antenna from the top of an automobile causes trouble as, for example, when the automobile is washed with an automatic car washing machine or when the automobile enters a garage having a low ceiling or door or when the automobile is to be covered with a suitable body cover as, for example, of plastic or fabric.

Conventional car antennas cannot be received within the antenna body and therefore the total height of the antenna is large. Thus, the antenna and antenna body comprise a substantial projection above the roof of the automobile. When the automobile is washed by an automatic washing machine or when the automobile enters a garage with low ceiling or a low garage door opening or when covered with a plastic or fabric covering it becomes necessary to remove the antenna structure from the top of the car which is inconvenient and time consuming.

SUMMARY OF THE INVENTION

It is an object of the present invention to provide an automobile antenna in which the antenna body does not need to be removed from the automobile when the automobile is washed as, for example, with an automatic washing machine or when the automobile passes through a low opening as, for example, in a garage with a low ceiling or when the automobile is covered with a cover.

Another object of the invention is to provide an automobile antenna which is very safe in that it will not be easily dislodged from the vehicle.

According to the invention, an automobile antenna is mounted on the roof of the automobile and includes an antenna body formed with antenna receiving grooves and has means for mounting the antenna body on the roof of the automobile which are attached to the bottom of the antenna body and wherein a pair of rod shaped antennas ae rotatably attached to the antenna body such that the rod shaped antennas can be received in the antenna receiving grooves when in the stored position when the antenna is not being used and can be moved to the operating position wherein the antenna rods are extended from the grooves to a predetermined V-shape when in use and wherein locking means are provided for locking the rod shaped antennas in the grooves when in the stored positions and holding means for holding the rod shaped antennas in the operating position when the antenna is being used.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DESCRIPTION OF THE PREFERRED EMBODIMENTS

Figure 1:
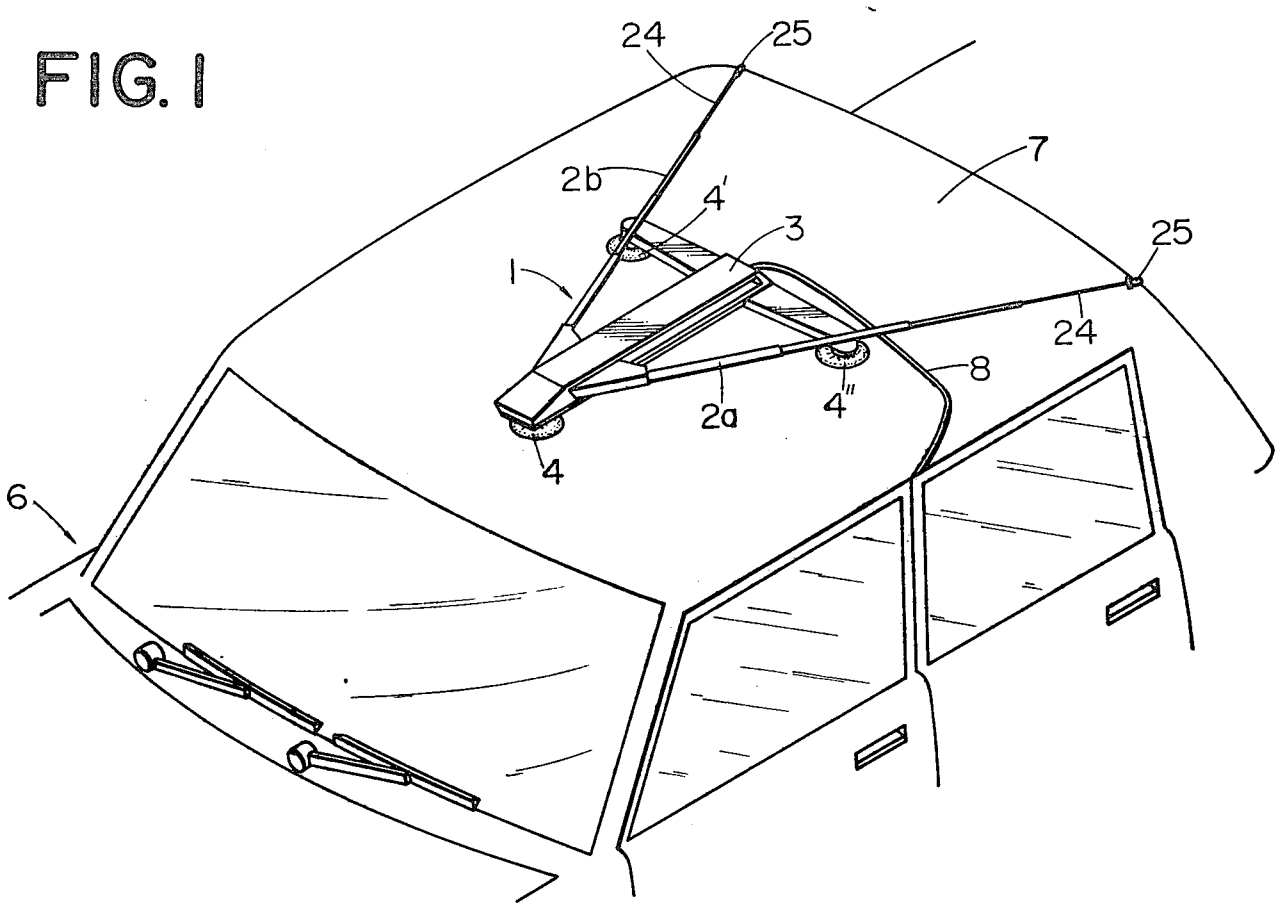
FIG. 1 is a perspective view of the automobile antenna of a first embodiment of the invention in the extended position.

FIGS. 1 through 10 illustrate a first embodiment of the invention. As shown in FIG. 1, the antenna 1 comprises a pair of telescoping rod antennas 2*a* and 2*b* which are pivotally connected to a T-shaped antenna body 3 which is attachable to the roof 7 of an automobile 6 by suction cups 4, 4' and 4'' mounted on the ends of the antenna body 3. Instead of suction cups, magnets suitably mounted on the end of the body member 3 may be utilized for attaching the antenna 1 to the roof 7 of the vehicle.

When the antenna is in use, the antenna rods 2*a* and 2*b* are extended and telescoped to the extended position to form a shape of the letter V with the apex of the V pointing in the forward direction of the vehicle.

Figure 2:
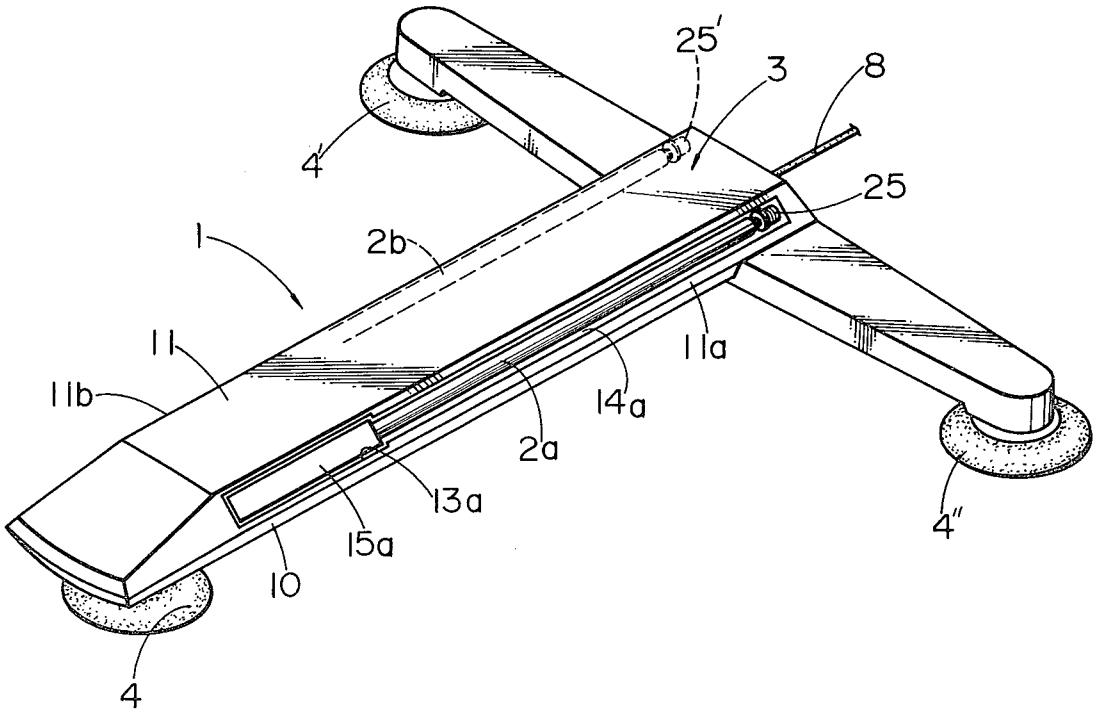
FIG. 2 is an enlarged perspective view of the car antenna of FIG. 1 with the antenna in the stored position.
Figure 3:
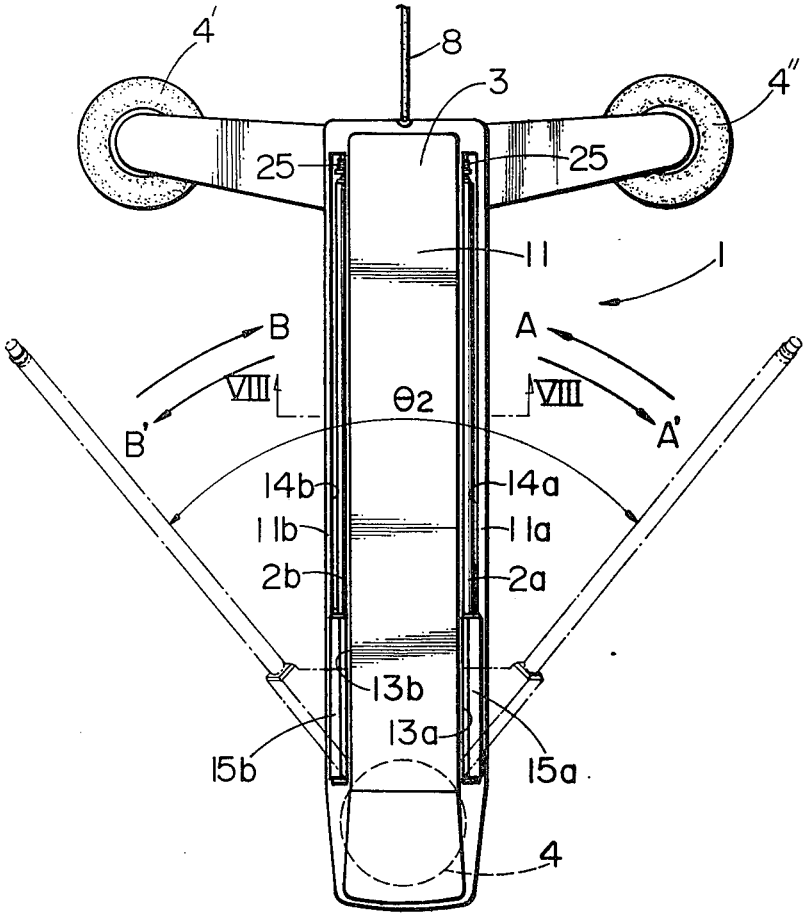
FIG. 3 is a top plan view of the antenna of FIG. 2.
Figure 4:
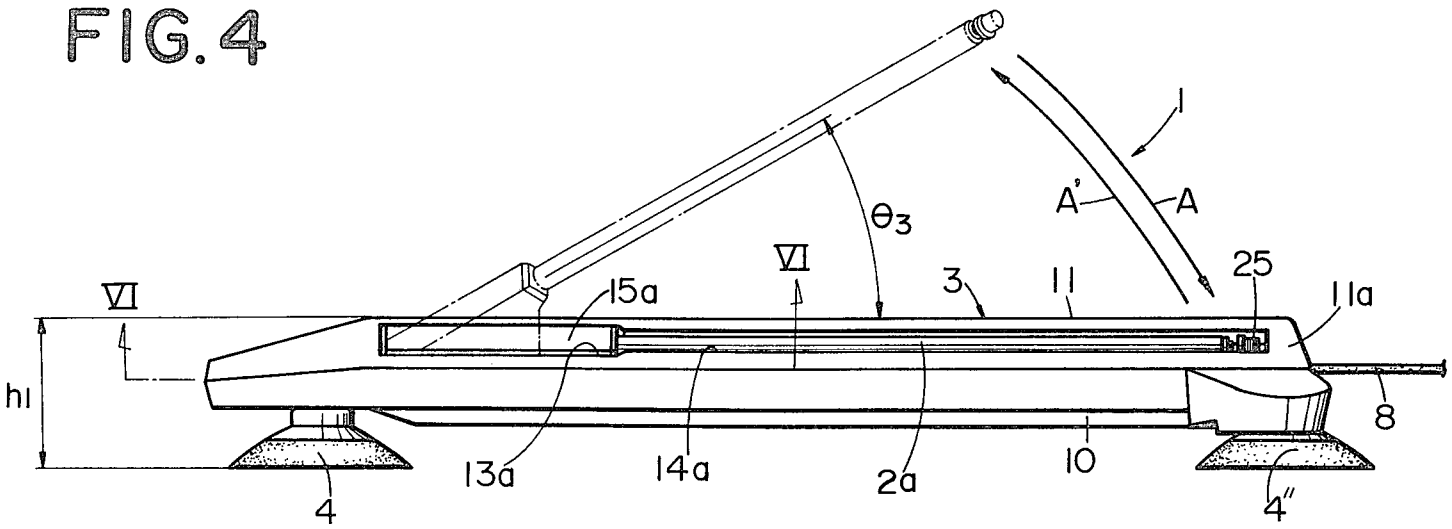
FIG. 4 is a side plan view of the antenna of FIG. 2.

The detail views of FIGS. 2 through 10 illustrate the first embodiment in greater detail and it is to be noted that the antenna body 3 comprises a substantially T-shaped flat base member 10 with a cover member 11 formed on the longer longitudinally extending portion of the T-shaped member 10. The base member and the cover member are attached to each other by screws 12 which may be made of synthetic resin. These screws are illustrated in the sectional view of FIG. 8. The base member 10 and the cover member 11 are designated as the antenna body 3 which is illustrated in FIG. 4 and as shown is flat and has a very small height $h_1$. The suction cups 4, 4' and 4'' are attached to the ends of the T-shaped member 10 by suitable screws.

Figure 7:
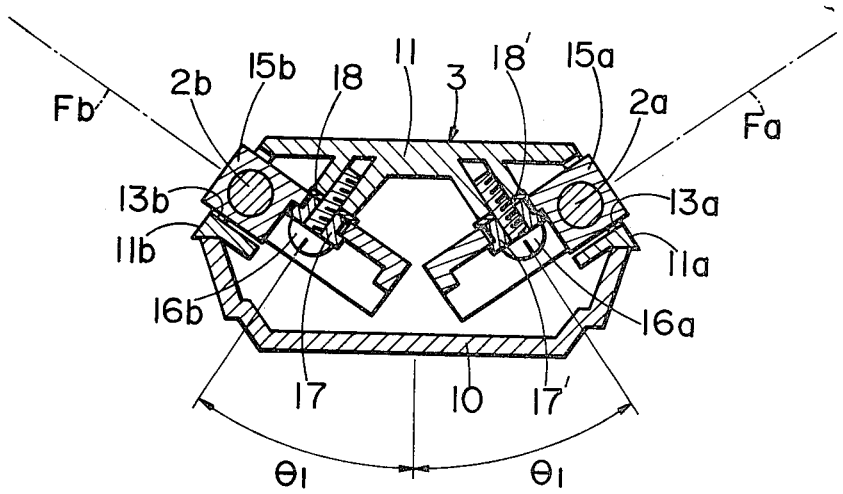
FIG. 7 is a cross-sectional view taken on line VII—VII from FIG. 6.
Figure 8:
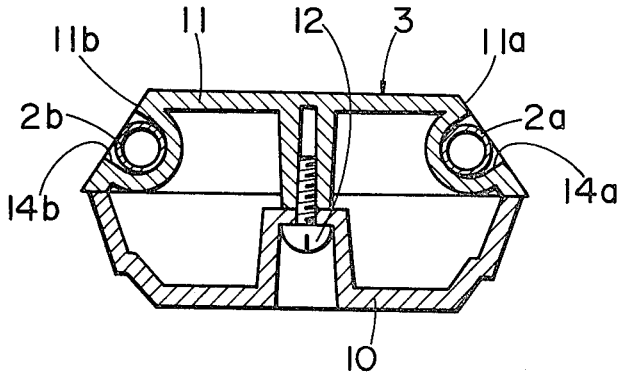
FIG. 8 is a cross-sectional view taken on line VIII—VIII in FIG. 3.

As illustrated in the sectional view of FIGS. 7 and 8, the side walls 11*a* and 11*b* of the cover member 11 slant upwardly and toward each other as shown and oblong openings 13*a* and 13*b* are formed in the front end portions of the slant walls 11*a* and 11*b* adjacent the suction cup 4 as illustrated in FIG. 4. Antenna receiving grooves 14*a* and 14*b* of substantially similar circular cross-section are formed in the slant side walls 11*a* and 11*b* and extend from the end of the oblong openings 13*a* and 13*b* toward the rear ends of the antenna as illustrated in FIGS. 3 and 4, for example. The grooves 14*a* and 14*b* are formed to be parallel with each other.

The rod antennas 2*a* and 2*b* are formed with base portions 15*a* and 15*b*, respectively, which are receivable into the oblong openings 13*a* and 13*b*, respectively, and as shown in FIG. 7 pivot screws 16*a* and 16*b* connect the base portions 15*a* and 15*b* to the cover member 11 so that the base portions 15*a* and 15*b* and the rod antennas 2*a* and 2*b* may be pivoted outwardly from the cover member 11. Bushings 17 and 17' surround the screws 16*a* and 16*b*, respectively, and slide washers 18 and 18' are used for mounting the base portions 15*a* and 15*b* to the cover member 11 as illustrated in FIG. 7. The screws 16*a* and 16*b* serve as pivot points for the rod antennas 2*a* and 2*b*. In use, the screws 16*a* and 16*b* do not become loose after repeated rotation of the base portions 15*a* and 15*b* which carry the rod antennas 2*a* and 2*b*. The base portions 15*a* and 15*b* may be made of a suitable metal.

Figure 6:
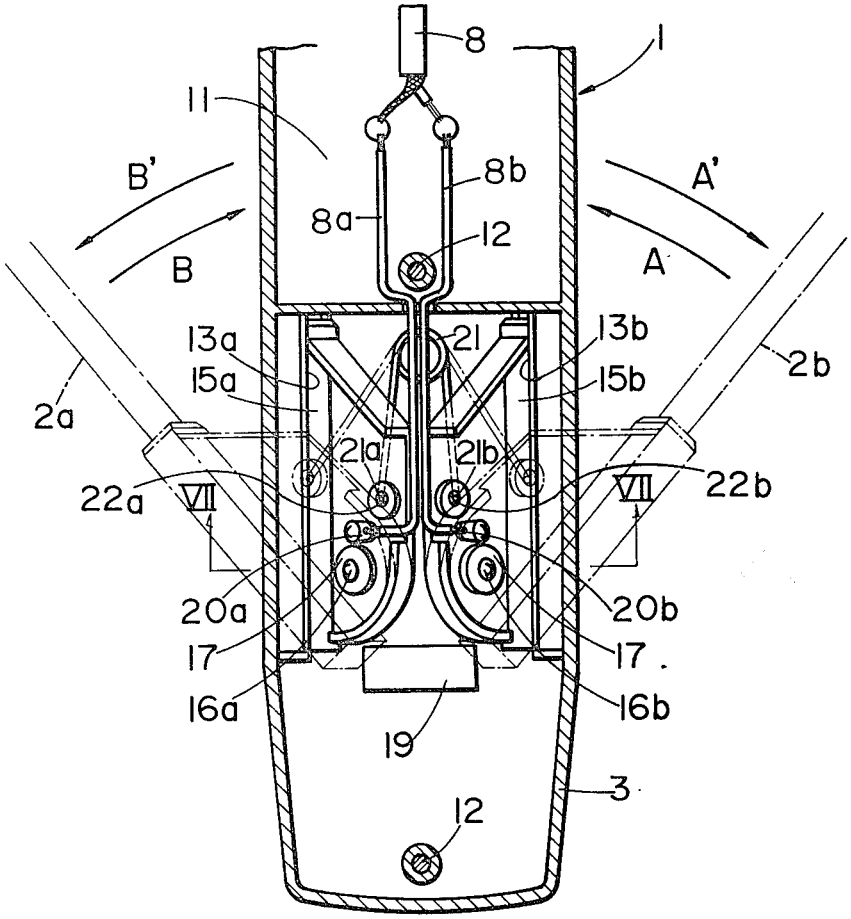
FIG. 6 is a top cross-sectional view taken along the line of VI—VI from FIG. 4.

As illustrated in FIG. 6, an electrical connection is made to the antenna from an electrical cord 8 which has a pair of leads 8*a* and 8*b* which are soldered to lug terminals 20*a* and 20*b* that are attached to the base portions 15*a* and 15*b* thus to make electrical contact with the extending rod portions 2*a* and 2*b* of the antenna.

The rod antenna elements 2*a* and 2*b* can be rotated around the screws 16*a* and 16*b* and since the screws 16*a* and 16*b* are inclined as illustrated in FIG. 7 by the angle $\theta_1$ relative to the vertical and the angle $\theta_1$ might be, for example, about 35° relative to the verticle as shown in FIG. 7. This will cause the rod antennas 2*a* and 2*b* to move in the slant planes F*a* and F*b*, respectively, which planes are at 90° relative to the axis of the screws 16*a* and 16*b*.

As shown in the top view of FIG. 3 when the antenna is to be placed in the stored position the rod antennas 2*a* and 2*b* are telescoped to the shortest length of the rods and are pivoted relative to the screws 16*a* and 16*b* so that the rods 2*a* and 2*b* are received into antenna receiving grooves 14*a* and 14*b* as illustrated in FIGS. 2, 3, 4 and 8 wherein they lie parallel to each other in the horizontal plane. When the antenna is to be used, the antenna rods 2*a* and 2*b* are rotated about the screws 16*a* and 16*b* from the antenna receiving grooves 14*a* and 14*b* to the extended position so that they form a V-shaped antenna illustrated by chain lines in FIGS. 3, 4, 5 and 6.

As shown in FIG. 6, the base portions 15*a* and 15*b* when in the fully extended position engage a stopper member 19 which is formed integrally with the cover member 11 so as to prevent the rod antennas 2*a* and 2*b* from moving beyond the limits established by the stopper member 19.

As shown in FIG. 6, end portions 21*a* and 21*b* of a torsion spring 21 engage grooves or openings 22*a* and 22*b* formed in the base portions 15*a* and 15*b* of the rod antennas 2*a* and 2*b* so as to urge the rod antennas 2*a* and 2*b* in the directions of the arrows A' and B'.

Figure 5:
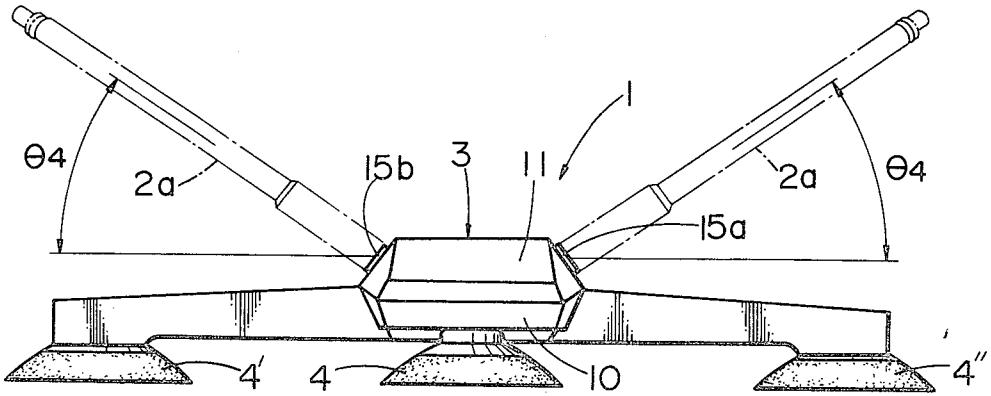
FIG. 5 is a front plan view of the automobile antenna of FIG. 2.

When the rod antennas 2*a* and 2*b* are to be moved into the stored position, they are pivoted into the cover member 11 by rotating them in the directions illustrated by arrows A and B against the tension of the torsion spring 21 and when the rod antennas 2*a* and 2*b* are in use, they are automatically rotated and held by the spring action of the torsion spring 21 in the extended position. The rod antennas 2*a* and 2*b* are maintained in the V-shaped extended position by the torsion spring 21 and by the position limiting action of the stopper member 19. As illustrated in FIG. 3, an angle $\theta_2$ exist between the extended antenna rods 2*a* and 2*b* in the operating position. The angle $\theta_2$ may be about 80°. As illustrated in FIG. 4, the elevation angle $\theta_3$ of the rod antennas 2*a* and 2*b* in the side view may be about 30°. As illustrated in FIG. 5, the elevation angle $\theta_4$ of the rod antennas 2*a* and 2*b* as viewed from the front end is about 35°. These values for the angles $\theta_1$, $\theta_2$, $\theta_3$ and $\theta_4$ are the optimum angles for receiving radio waves with a television antenna.

Figure 9:
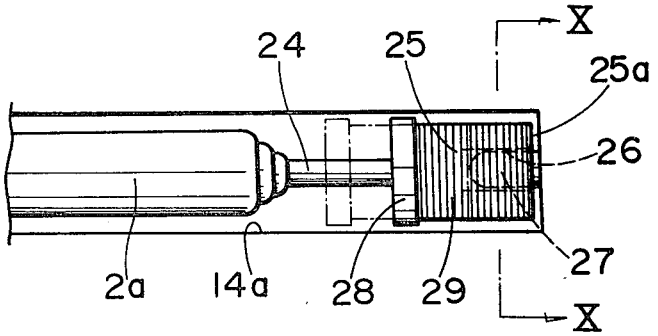
FIG. 9 is an enlarged side view of the locking mechanism of the antenna of FIG. 1.
Figure 10:
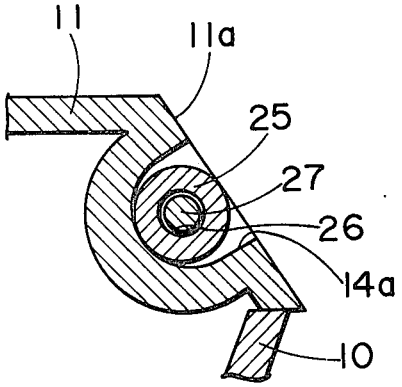
FIG. 10 is a cross-sectional view taken along the line of X—X from FIG. 9.

When the rod antennas 2*a* and 2*b* are in the stored position, they are locked in the antenna receiving grooves 14*a* and 14*b* by the locking mechanisms illustrated in FIGS. 9 and 10 and which are also shown in FIG. 2 which illustrates knobs 25 and 25', respectively, attached to the ends of rods 2*a* and 2*b*. The knobs 25 and 25' are attached to the tops of the central rods 24 of the retractable rod antennas 2*a* and 2*b* and engaging holes 26 are formed in the centers of the knobs 25 and 25' as shown in FIGS. 9 and 10. Pins 27 are attached to the rear portions of the antenna receiving grooves 14*a* and 14*b* and are receivable in the openings 26 formed in the ornamental knobs 25 and 25'.

In the locked position, the knobs 25 are slid to the locked position shown in solid line in FIGS. 9 and 10 wherein the pins 27 are received into the openings 26 so as to lock the rods 2*a* and 2*b* in the grooves 14*a* and 14*b*. Of course, so as to lock the knobs 25 on the pins 26 the knobs 25 must be slid to the chain line illustrated position of FIG. 9 and then moved to the solid line position of FIG. 9.

So as to unlock the rod antennas 2*a* and 2*b* from the grooves 14*a* and 14*b*, the knobs 25 are slid to the chain line position illustrated in FIG. 9 to move the knobs 25 axially on the ends 24 of the antenna rods so that the rods will be extended by the spring 21 to the operating position.

The antenna of the invention has a height $h_1$ of the antenna body 3 which is very small. The antenna body 3 is generally flat and when the antenna is not in use and in the stored position the antenna rods 2*a* and 2*b* are received and locked in the antenna receiving grooves 14*a* and 14*b* of the antenna body 3 which holds the rods in the horizontal position. Thus, when in the stored position, the antenna 1 can remain on the roof of the car during washing with an automatic washing machine or when the vehicle passes through an opening which has low overhead clearance such as a low garage or when the vehicle is to be covered with a body cover. The rod antennas 2*a* and 2*b* can be quickly and easily inserted into the antenna rod stored position and since the rod antennas 2*a* and 2*b* are locked in the stored position by the knobs 25 and the associated locking pin 27, the rod antennas will not unexpectedly move from the antenna receiving grooves 14*a* and 14*b* and be engaged with a washing brush so as to damage it or the antenna when the vehicle is being washed. This renders the car antenna of the invention very safe during operation.

When the car antenna is to be used, the lock which holds the rod antennas 2*a* and 2*b* in the grooves 14*a* and 14*b* are released and the rod antennas 2*a* and 2*b* will be automatically projected to the operating position from the antenna grooves 14*a* and 14*b* by the action of the torsion spring 21 and they will be automatically extended to the predetermined angles. The operation is simple and quick and the rod antennas 2*a* and 2*b* will extend upwardly and rearwardly as shown in FIG. 1.

The angle to which the rod antennas 2*a* and 2*b* is accurately regulated and controlled by the stopper member 19 and the rod antennas 2*a* and 2*b* will be positioned at an elevation angle which assures that they are sufficiently separated from the roof 7 and radio waves will be received under the optimum conditions.

The predetermined elevation angle of the rod antennas 2*a* and 2*b* is determined in a simple manner by assuring that the pair of screws 16*a* and 16*b* which function as the fulcrum for the antenna rods 2*a* and 2*b* are slanted at the suitable angle $\theta_1$ as shown in FIG. 7. In the invention, the rods 2*a* and 2*b* can be retracted, extended, locked and released by the ornamental knobs 25 and very small number of parts is required for the antenna. The construction of the antenna is simple and inexpensive because of the small number of steps for assembling the antenna and the resulting car antenna is very simple in construction. Also, there are very few things which can go wrong with the antenna and the antenna is very reliable.

Figure 11:
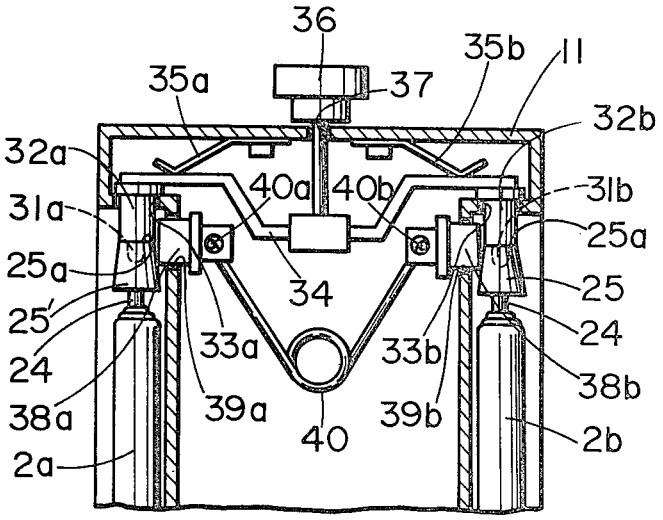
FIGS. 11 and 12 are enlarged cross-sectional views illustrating a second locking means of a modification of the invention.
Figure 12:
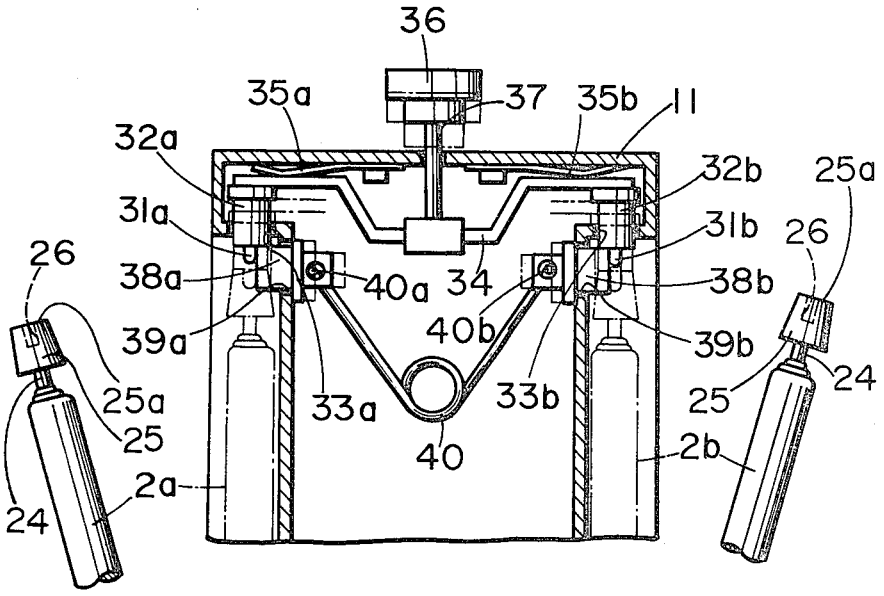

FIGS. 11 and 12 illustrate a second embodiment of the invention and in this embodiment the rod antennas 2*a* and 2*b* when mounted in the antenna receiving grooves 14*a* and 14*b* can be locked or released by a single touch operation rather than the movement of a pair of knobs 25 as in the embodiment illustrated in FIGS. 2 through 10.

A pair of engaging members 32*a* and 32*b* which have pins 31*a* and 31*b* which extend toward the rod antennas 21*a* and 21*b* are mounted at the rear ends of the antenna receiving grooves 14*a* and 14*b*. The pins 31*a* and 31*b* of the engaging members 32*a* and 32*b* can be inserted into the engaging holes 26 of the ornamental knobs 25 and 25'. The engaging members 32*a* and 32*b* are slidably received into openings 33*a* and 33*b* formed in the rear end walls of the antenna receiving grooves 14*a* and 14*b*. Engaging members 32*a* and 32*b* are connected to a laterally extending connecting member 34 as shown. A pair of leaf springs 35*a* and 35*b* urge the connecting member 34 forward toward the rod antennas 2*a* and 2*b* and are connected to the rear wall of the body member 11.

A knob 36 is attached to a shaft which extends through an opening 37 formed in the rear wall of the cover member 11 and the other end of the shaft is connected to the member 34 such that movement of the knob upwardly and downwardly relative to FIGS. 11 and 12 will move the engaging members 32*a* and 32*b* as shown.

A pair of stopper members 38*a* and 38*b* are mounted adjacent the engaging members 32*a* and 32*b* and are slidably receivable through openings 39*a* and 39*b* formed in the rear ends of the side walls of the antenna receiving grooves 14*a* and 14*b*. The stopper members 38*a* and 38*b* are urged by a spring 40 toward the engaging members 32*a* and 32*b*. Spring end 40*a* urges member 38*a* toward engaging member 32*a* and spring end 40*b* urges stopper member 38*b* toward engaging member 32*b*. The torsion spring 40 is formed generally in the shape of a pair of scissors.

In this embodiment the locking and locking release mechanism provides that the pins 31*a* and 31*b* are inserted into the engaging holes 26 of the ornamental knobs 25 and 25' to lock the rod antennas 2*a* and 2*b* in the stored position when the rod antennas 2*a* and 2*b* are stored in the antennas receiving grooves 14*a* and 14*b*. The ornamental knobs 25 and 25' are in contact with the stopper members 38*a* and 38*b* to push them inwardly against the torsion spring 40.

When the operating knob 36 is pulled rearwardly to the upper position relative to FIGS. 11 and 12 against the leaf springs 35*a* and 35*b*, the pins 31*a* and 31*b* of the engaging members 32*a* and 32*b* will be simultaneously drawn out of the engaging holes 26 of the ornamental knobs 25 and 25' to release and unlock the rod antennas 2*a* and 2*b*. They will immediately be automatically projected from the antenna receiving grooves 14*a* and 14*b* by the action of the torsion spring 21 and will be extended in the operating V-shape.

When the operating knob 36 is released by the operator, the engaging members 32*a* and 32*b* will be moved forward by the action of the leaf springs 35*a* and 35*b*. The stopper members 38*a* and 38*b* will be projected outwardly as shown in FIG. 12 by the spring action of the torsion spring 40 at the time when the rod antennas 2*a* and 2*b* will have been projected from the antenna receiving grooves 14*a* and 14*b*. The forward moving engaging members 32*a* and 32*b* come into contact with the stopper members 38*a* and 38*b* as shown by the chain line view in FIG. 12. Thus, the forward movement of the engaging members 32*a* and 32*b* is limited by the stopper members 38*a* and 38*b*. Thus, the engaging members 32*a* and 32*b* do not move to the positions where they were when they engaged the ornamental knobs 25 and 25' of the rod antennas 2*a* and 2*b*.

When the rod antennas 2*a* and 2*b* are again retracted into the antenna receiving grooves 14*a* and 14*b*, the ornamental knobs 25 and 25' come into contact with the stopper members 38*a* and 38*b* and push them inwardly to the positions shown by the chain line view in FIG. 12 against the torsion spring 40. When this occurs, the stopper members 38*a* and 38*b* will be disengaged from the engaging members 32*a* and 32*b* so that the engaging members 32*a* and 32*b* will be moved forwardly by action of the leaf springs 35*a* and 35*b* and the pins 31*a* and 31*b* of the engaging members 32*a* and 32*b* will be inserted into the engaging holes of the ornamental knobs 25 and 25'. Thus, the rod antennas 2*a* and 2*b* will be automatically locked in the antenna receiving grooves 14*a* and 14*b*.

Figure 13:
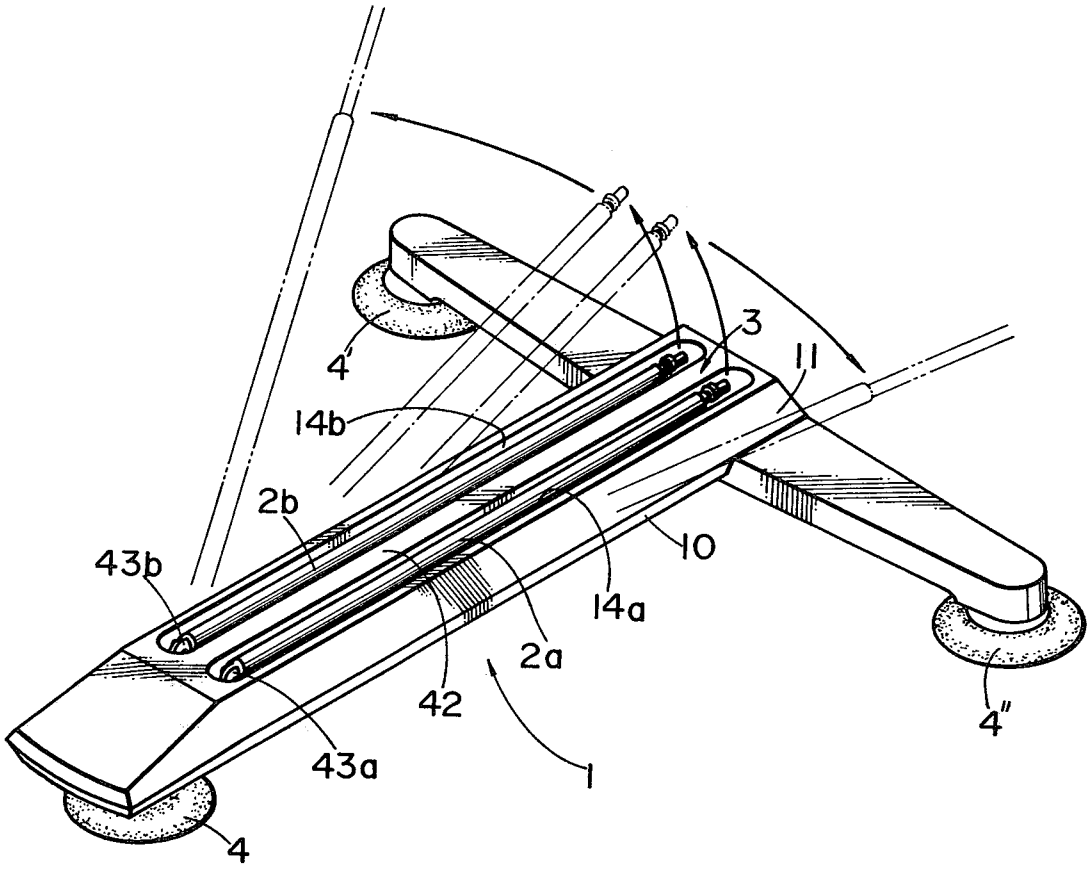
FIG. 13 is a perspective view illustrating a third embodiment of the invention.

FIG. 13 illustrates a third embodiment of the invention wherein a pair of antenna rods 2*a* and 2*b* are mounted into a pair of antenna receiving grooves 14*a* and 14*b* formed in the upper surface 14 of the antenna body 3. The grooves 14*a* and 14*b* are parallel to each other and the antenna rods 2*a* and 2*b* move into the grooves from above.

The rod antennas 2*a* and 2*b* are supported at their front ends by pivot mechanisms 43*a* and 43*b* which allow them to rotate in the vertical and the horizontal directions. When the automobile antenna 1 is used, the rod antennas 2*a* and 2*b* are first rotated upwardly to the positions shown in dot dash lines in FIG. 13 from the antenna receiving grooves 14*a* and 14*b* and then they are horizontally rotated to the predetermined positions shown by the two-dot dash lines in FIG. 13. Thus, they are extended to the predetermined desired V-shape. In this embodiment, a pop-up mechanism may be employed for automatically moving the rod antennas 2*a* and 2*b* to the positions shown by the dot dash lines in FIG. 13 so as to move the antenna rods to the extended operating position.

Figure 14:
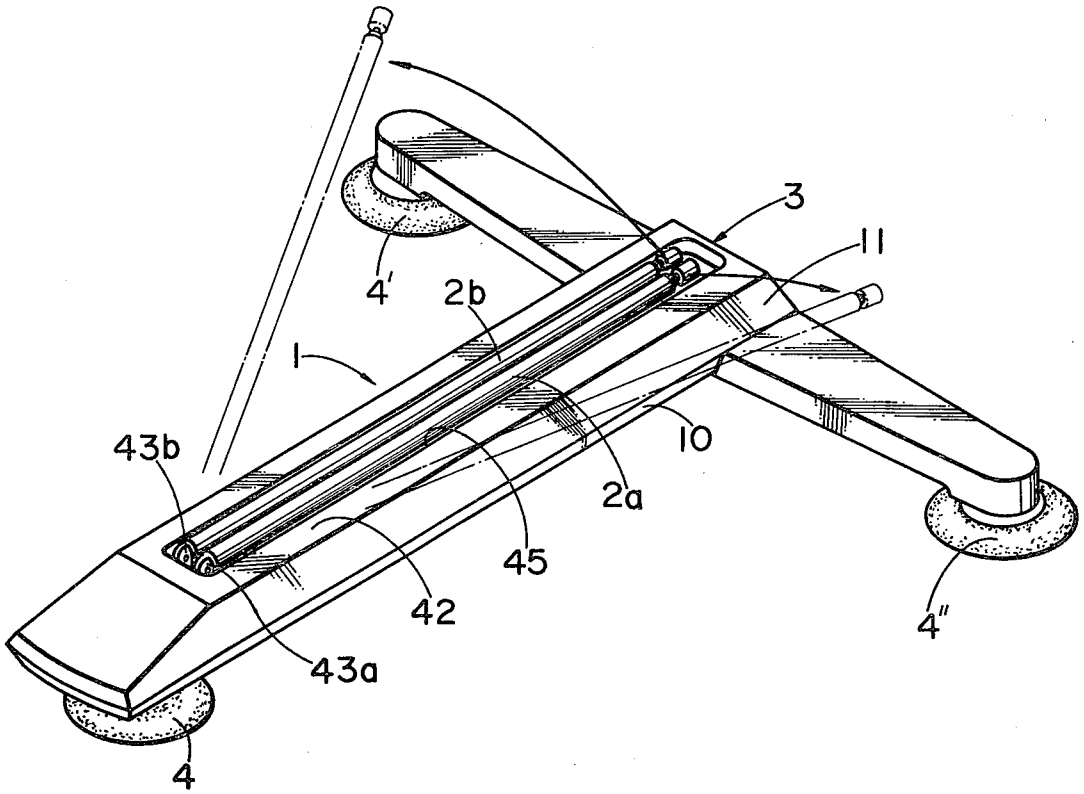
FIG. 14 is a perspective view of an automobile antenna comprising a fourth embodiment of the invention.

FIG. 14 illustrates a fourth embodiment of the invention where a single antenna receiving groove 45 is made in the central portion of the upper part 42 of the antenna body 3 and the antenna rods 2*a* and 2*b* are introduced into the single antenna receiving groove 45 from above. The antenna rods 2*a* and 2*b* are extended outwardly to the operating position when the antenna is in use.

In the embodiments illustrated in FIGS. 13 and 14 the cross-section of the antenna receiving grooves 14*a*, 14*b* and 45 may be V-shaped. With this construction, pivot pins for supporting the rod antennas 2*a* and 2*b* will be inclined and mounted in the inverted V-shaped grooves as in the embodiment illustrated in FIGS. 2 through 10. With such mounting, the rod antennas 2*a* and 2*b* can be moved directly to the predetermined desired positions from the antenna receiving grooves 14*a* and 14*b* from the stored positions.

In the above described embodiments, the ornamental knobs 25 and 25' are used in the locking mechanism for locking the rod antennas in the stored position. However, instead of ornamental knobs, the base portions of the rod antennas formed as pipe portions may be used as a portion of the locking mechanism.

In the embodiments described, the spring 21 and the stopper member 19 are used as the holding mechanism for holding the rod antennas in the extended V-shaped. However, it is to be realized that any locking means for locking the base portions of the rod antennas may be used in the holding mechanism instead of the spring 21 and the stopper 19.

In the above described embodiments, the rod antennas are automatically moved out into the V-shaped operating position from the antenna receiving grooves by the action of springs. However, the antenna elements may also be manually moved to the operating position without the use of springs.

In the description suction cups 4, 4' and 4'' are illustrated for mounting the antenna body on the roof of the vehicle, however, magnets or other mechanical attaching means may be used for this purpose.

Although the invention has been described with respect to preferred embodiments, it is not to be so limited as changes and modifications may be made therein which are within the full intended scope as defined by the appended claims.

We claim:

1. A car antenna for mounting on a roof of an automobile, comprising:

(A) an antenna body having antenna-receiving grooves;

(B) means for mounting said antenna body on the roof of the automobile attached to the bottom of said antenna body;

(C) a pair of rod antennas rotatably attached to said antenna body, said rod antennas being movable to a stored position in said antenna receiving grooves when not in use, and said pair of rod antennas movable to an extended upwardly, outwardly and rearwardly directed V-shaped position from said antenna receiving grooes when in use;

(D) locking means for locking said pair of rod antennas in said antenna receiving grooves when not in use; and (E) holding means for holding said rod antennas in said extended V-shape position when in use.

2. A car antenna according to claim 1, further comprising spring means for urging said pair of rod antennas in directions to extend said rod antenna to said extended V-shaped position so that said pair of rod antennas are automatically biased out from said antenna receiving grooves when said locking means is released.

3. A car antenna according to claim 1, in which the vertical height of said antenna body is small, and said antenna body is substantially flat.

4. A car antenna according to claim 1, including a pair of pivotal pins are attached to said antenna body for supporting said rod antennas and said pins are inclined so that their longitudinal axes form a substantially inverted V so as to impart a predetermined elevation angle to said pair of rod antennas when they are in the extended V-shape position.

5. A car antenna according to claim 1, in which a pair of engaging members are mounted in the ends of said antenna receiving grooves, a pair of ornamental knobs fixed to the top ends of said pair of rod antennas, said ornamental knobs engageable with said pair of engaging members to lock the pair of rod antennas in the stored position by axial movement of said pair of ornament knobs.

6. A car antenna according to claim 5 including a connecting means including an operating knob mounted on said antenna body and engageable with engaging members to selectively move them from engagement with said ornamental knobs, spring means mounted for urging said engaging members in directions to engage with said pair of ornamental knobs such that said rod antennas can be released by movement of said operating knob and said engaging members will be moved in directions so as to disengage them from said ornamental knobs.

7. A car antenna according to claim 1, in which the material between said pair of antenna receiving grooves is removed to form one common antenna receiving groove.

8. A TV antenna for a motor vehicle comprising a generally longitudinal antenna body member formed with a pair of longitudinal grooves for receiving rod antenna elements and attachable to the roof of a motor vehicle, a pair of rod antenna elements pivotally attached to said body member so as to be, respectively, received in a longitudinal groove in a retracted stored position, so that said antenna has a small vertical height, locking means for locking said rod antenna elements in said stored position, and spring biasing means connected to pair of rod antenna elements to cause them to move to an extended outwardly, upwardly and rearwardly directed V-shaped operating position when said locking means are released.

9. A TV antenna according to claim 8 including a stopper means engageable with said pair of rod antenna elements to limit their angular movement when in the extended operating position.

10. A TV antenna according to claim 9 wherein said locking means comprises a pair of knob members respectively mounted on said pair of rod antenna elements, and a pair of engaging means mounted on said body member and detachably engageable with said pair of knob members.

* * * * *